United States Patent [19]

Brown

[11] Patent Number: 5,040,741

[45] Date of Patent: Aug. 20, 1991

[54] METHOD AND APPARATUS FOR ESTABLISHING AND MAINTAINING A SELECTED TENSION ON UNCOILING WIRE

[76] Inventor: Maurice H. Brown, 11704 South Mayfield Ave., Worth, Ill. 60482

[21] Appl. No.: 521,016

[22] Filed: May 9, 1990

[51] Int. Cl.[5] ..... B65H 59/06; B65H 49/02

[52] U.S. Cl. ..... 242/128; 242/129.8; 242/147 R

[58] Field of Search ..... 242/156, 156.2, 128, 242/129.5, 147 R, 155 R, 129.8

[56] References Cited

U.S. PATENT DOCUMENTS

| | | | |
|---|---|---|---|
| 3,023,979 | 3/1962 | Megens et al. | 242/155 R |
| 3,972,489 | 8/1976 | Kovaleski | 242/128 |
| 3,990,652 | 11/1976 | Brown | 242/129.8 |
| 4,508,290 | 4/1985 | Bauer | 242/128 |

*Primary Examiner*—Stanley N. Gilreath

*Attorney, Agent, or Firm*—Kinzer, Plyer, Dorn, McEachran & Jambor

[57] ABSTRACT

A method and apparatus for establishing and maintaining a selected tension on ultrafine wire being uncoiled over the end of a spool of such wire. In one embodiment, the apparatus includes a dish having outwardly-extending filaments which engage the wire as it is uncoiled over the end of a spool of wire. In another embodiment, the apparatus incudes a disk having an arm which engages and constrains the wire as it is uncoiled over the end of a spool of wire. A braking mechanism which slows rotation of the disk is disengaged from the disk by a coiled compression spring. A cable connected to the braking mechanism and a tension spring applies a preset compression force to the spring. This force may be adjusted by varying the expansion of the tension spring. The compression force exerted by the cable against the spring is reduced as tension increases on the uncoiling wire by an arm supported pulley which supports the uncoiling wire and moves the cable.

6 Claims, 5 Drawing Sheets

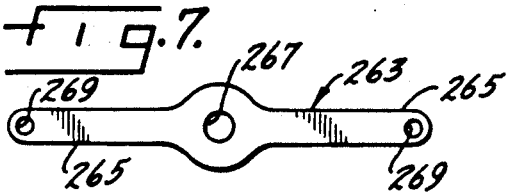
Fig. 7.
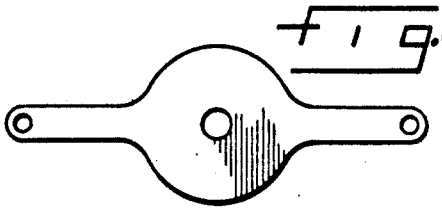
Fig. 8.
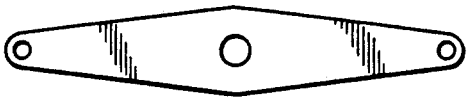
Fig. 9.
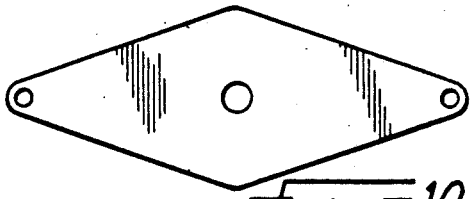
Fig. 10.
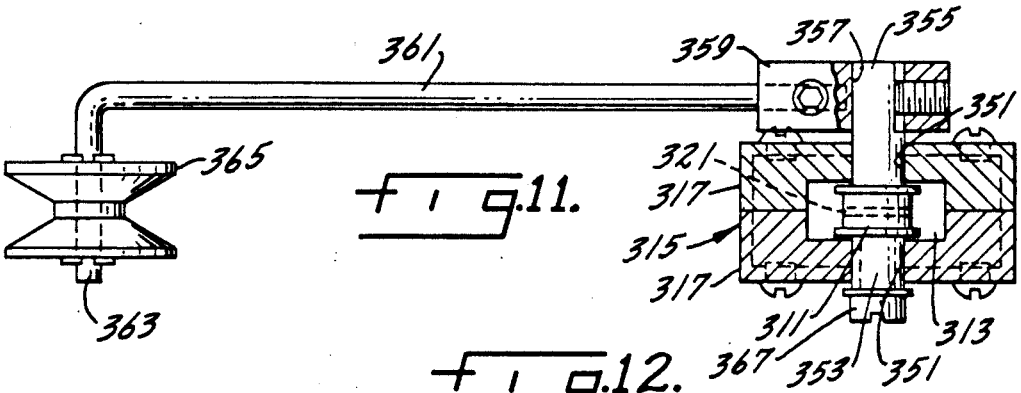
Fig. 11.
Fig. 12.
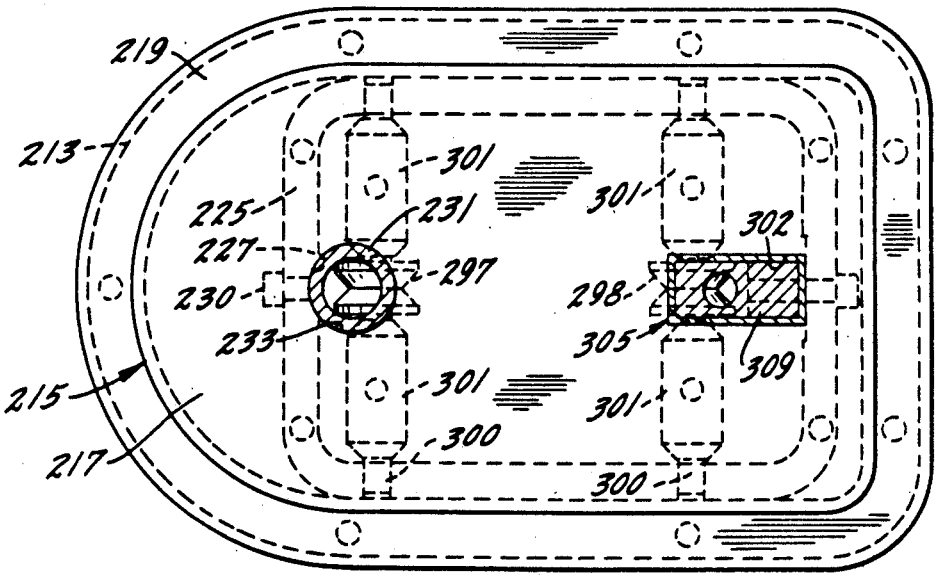

METHOD AND APPARATUS FOR ESTABLISHING AND MAINTAINING A SELECTED TENSION ON UNCOILING WIRE

SUMMARY OF THE INVENTION

This invention is concerned with a method and an apparatus for maintaining uniform tension on a moving wire, especially a wire that is uncoiled over the axially end of a fixed spool of wire. It is particularly concerned with an apparatus which automatically maintains a preselected tension on an uncoiling wire as forces acting on the wire vary. As an ultrafine wire is unwound over an axial end of a fixed coil or spool of wire, it has a tendency to curl or twist. Further, when such ultrafine wire is rapidly accelerated and decelerated during winding, for example, during the winding of a coil having a core of square or rectangular cross-section, the tension applied to the wire varies considerably. This variation in tension can result in breakage of the wire.

In my previous U.S. Pat. No. 3,990,652, issued Nov. 9, 1976, I disclosed a device for applying generally uniform tension to wire of fine diameter, including a disk having a plurality of radially-extending filaments, which protrude beyond the periphery of the axial end of a spool of wire and engage the wire as it is unwound from the spool. This tensioning device included means to bend the filaments of the disk in the direction of uncoiling of the wire as the uncoiling resistance of the wire increased in order to maintain a relatively constant tension on the wire during uncoiling. Whereas, the device of my aforementioned patent works extremely well with wire having a diameter in the range of 40 AWG, my present invention is directed to a method and a device for selecting and maintaining proper tension on even finer wire such as wire having a diameter in the range of 44 to 56 AWG during uncoiling operations.

BRIEF DESCRIPTION OF THE DRAWINGS

The invention is illustrated more or less diagrammatically in the following drawings wherein:

FIGS. 7–10 are detail views of friction members;

FIG. 11 is a cross-sectional view taken along line 11—11 of FIG. 6; and

FIG. 12 is a cross-sectional view taken along line 12—12 of FIG. 6.

DESCRIPTION OF THE PREFERRED EMBODIMENTS

Figure 1:
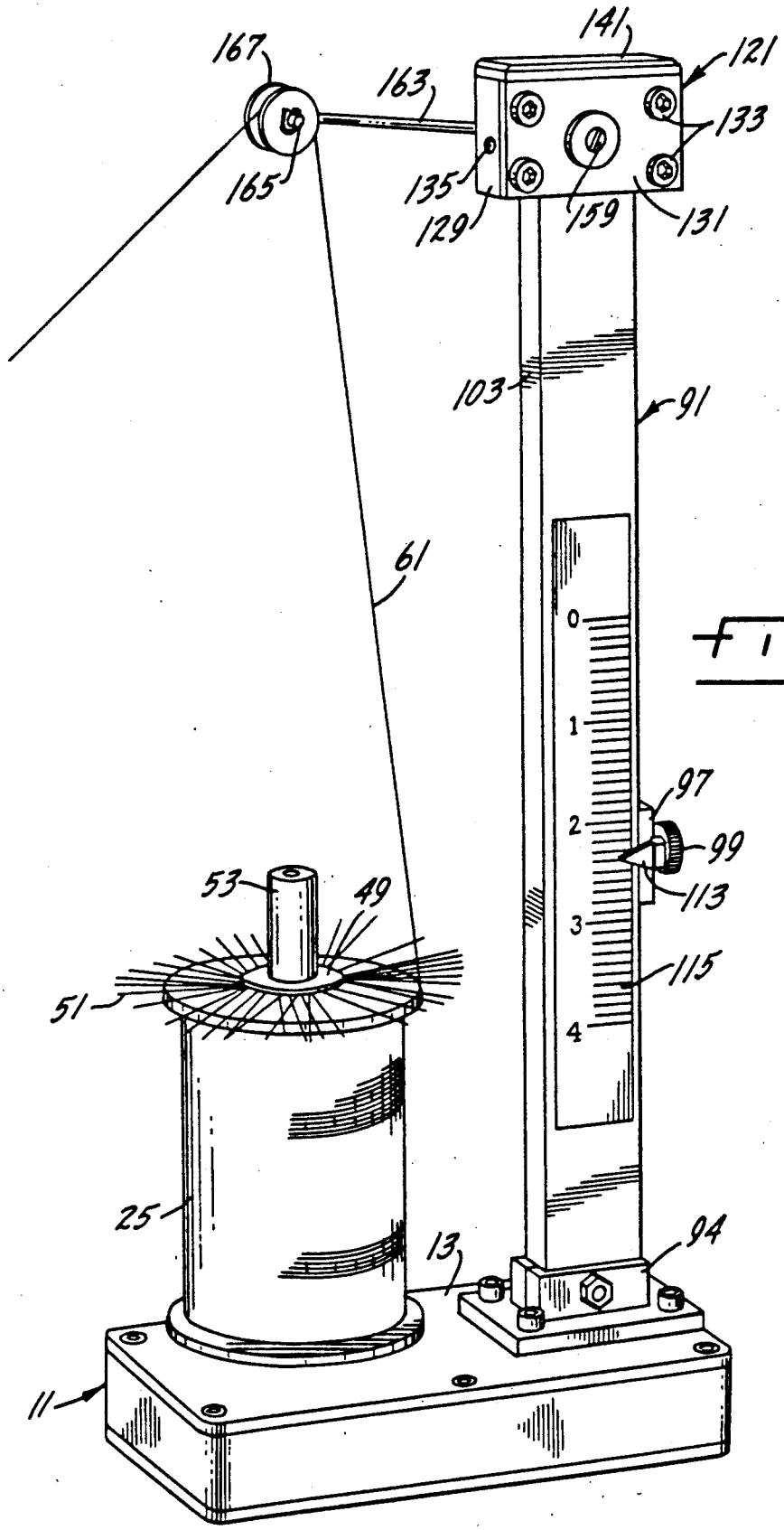
FIG. 1 is a perspective view of one form of apparatus embodying the novel aspects of this invention.
Figure 2:
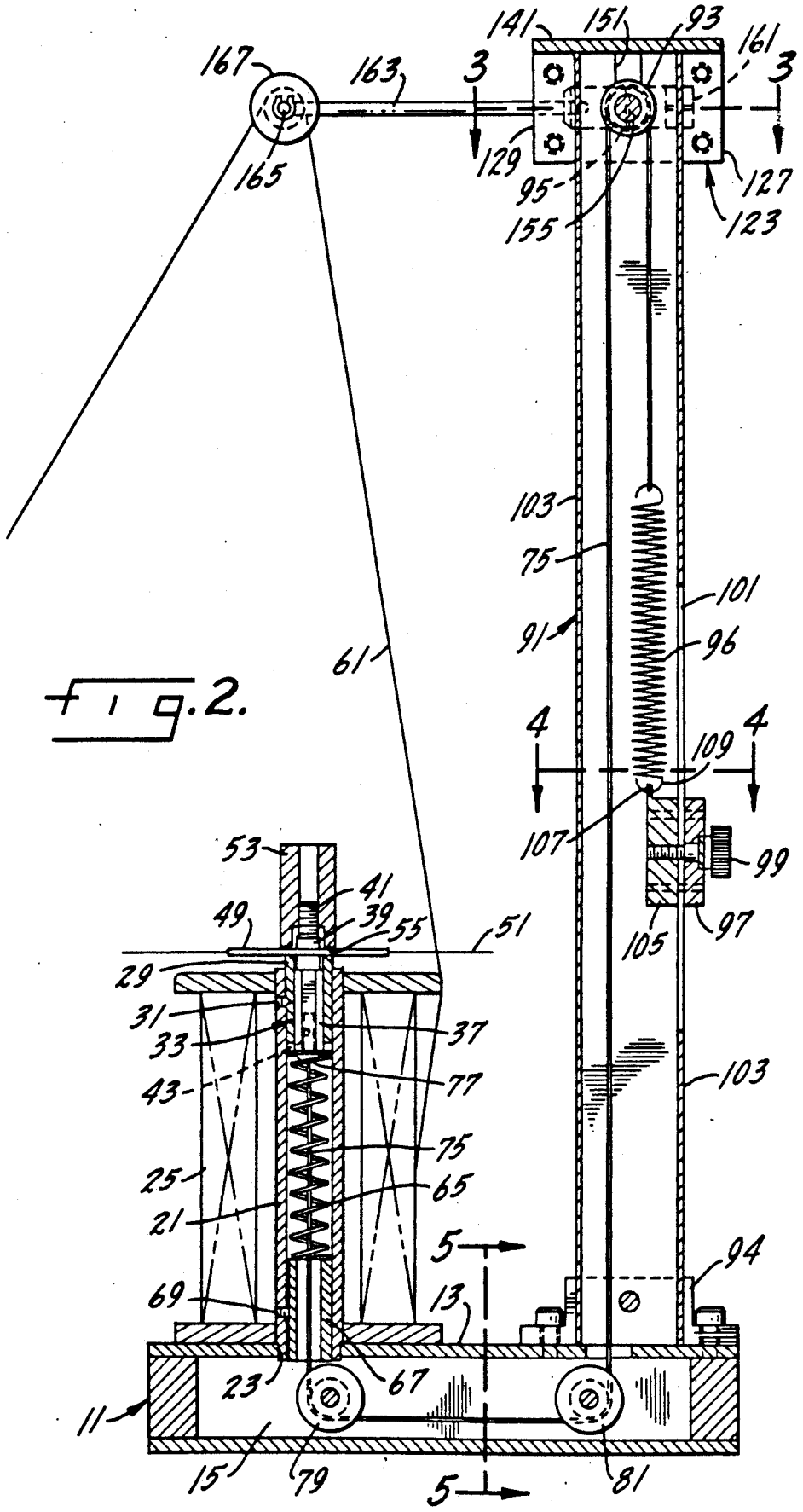
FIG. 2 is a vertical, cross-sectional view through the apparatus of FIG. 1.
Figure 3:
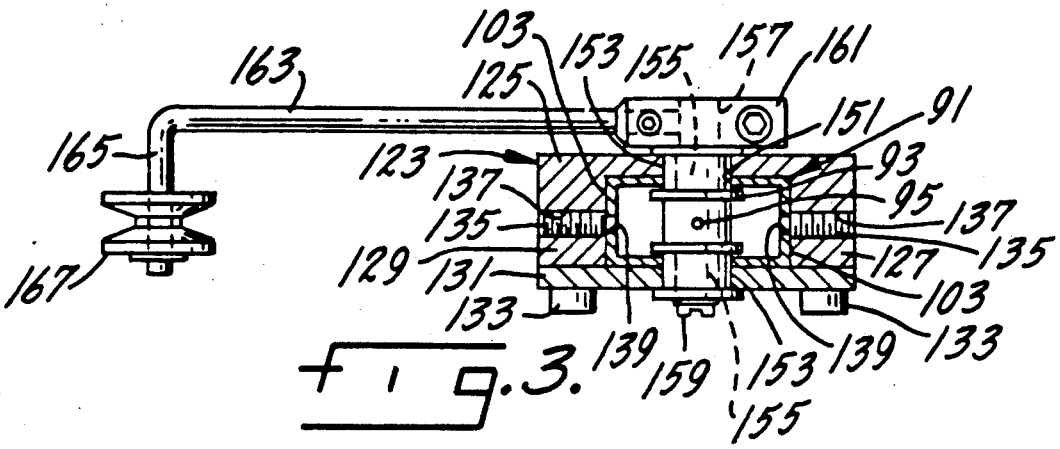
FIG. 3 is a cross-sectional view taken along line 3—3 of FIG. 2.
Figure 4:
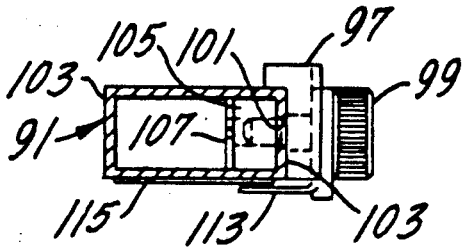
FIG. 4 is a cross-sectional view taken along line 4—4 of FIG. 2.
Figure 5:
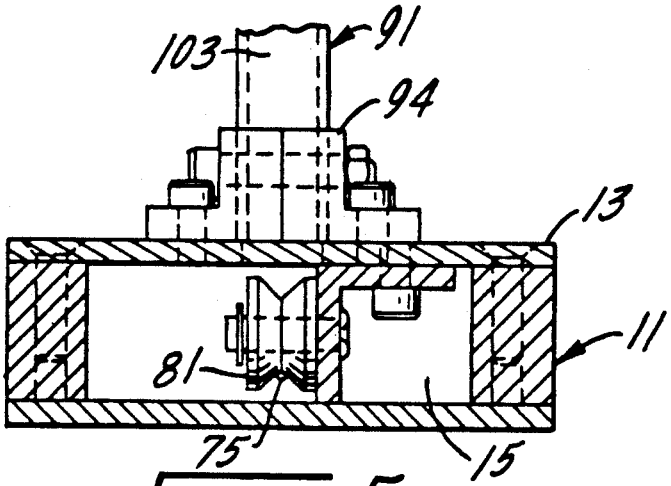
FIG. 5 is a partial, cross-sectional view taken along line 5—5 of FIG. 2.
Figure 6:
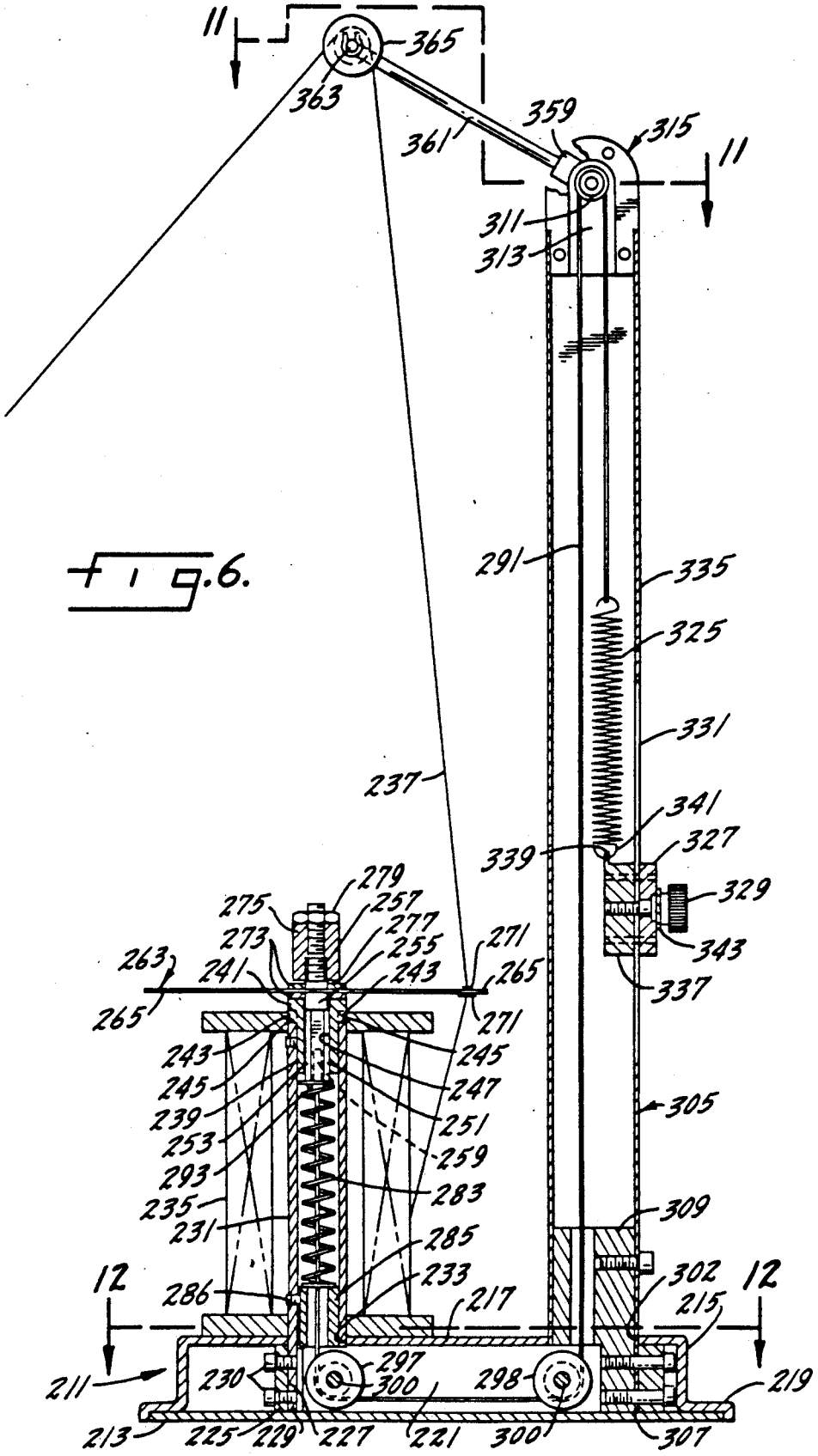
FIG. 6 is a vertical, cross-sectional view through another form of apparatus embodying the novel aspects of this invention.

One embodiment of an apparatus involving the novel features of this invention is shown in its overall construction in FIGS. 1 and 2 and in detail in FIGS. 3 to 5 of the drawings. The apparatus includes a hollow base 11 having a top wall 13. A cavity 15 is defined by the top wall 13 and the other walls of the base. A tubular column 21 is positioned upright in an opening 23 formed in the top wall 13 of the hollow base. The column 21 is designed to receive and position a spool 25 of ultrafine, metallic wire. By ultrafine, I am referring to wire having a diameter of 44 to 56 AWG. A sleeve 29 telescopes into the top of the tubular column 21 and extends somewhat above the top of the column. It is held in place by a set screw 31. The interior passage of the sleeve is hexagonal in transverse cross-section and receives a rod 33 having a hexagonal base 37. The rod has a cylindrical portion 39 at the upper end of its base and a threaded portion 41 at the upper end of its cylindrical portion, as shown in FIG. 2. A threaded blind hole 43 is formed in the lower end of the hex base 37.

A filament disk 49 having a plurality of outwardly-extending, resiliently, flexible filaments 51 extending from the disk is mounted on the cylindrical portion 39 of the rod 33, with the disk supported on the upper end of the sleeve 29. A cylindrical nut 53 screws onto the threaded portion 41 of the rod 33. The cylindrical nut 53 has an annular, downwardly-facing brake surface 55 which is positioned to engage the disk 49 to force it in contact with the upper end of the sleeve 29, thereby functioning as a caliper brake to slow or stop rotation of the disk 49. The disk is rotated as the ultrafine wire 61 is uncoiled from the spool 25 and engages the filaments as it is uncoiled to spin the filaments and the disk.

A coiled compression spring 65 is located in the tubular column 21 beneath the rod 33. The spring rests on a sleeve 67 located in and secured by a set screw 69 to the lower end of the tubular column 21.

A cable 75 is connected to a screw 77 threaded in the blind hole 43 of the post 33. The cable functions to pull the rod 33 downwardly against the coiled spring 65 to compress the coiled spring. The cable 75 extends through the sleeve 67 into the cavity 15 of the hollow base 11 where it is guided around pulleys 79 and 81 mounted in the hollow base and directed upwardly through a rectangular tubular column 91 mounted on the top wall 13 of the base 11. A split collar 94 surrounds the base of the tubular column 91 and is fastened to the top wall 13 of the hollow base 11. The cable 75 connects to a drum 93 rotatably mounted near the top of the tubular column 91. The connection is made by passing the cable 75 through a diametrically-extending passage 95 formed in the drum 93, as is most clearly shown in FIGS. 2 and 3 of the drawings. The cable continues from the drum 93 downwardly to a spring 96, which is connected to a slidable adjustment member 97, which can be moved vertically along the length of the column 91 and held in a selected position by a thumbscrew 99, which extends through a slot 101 formed in an end wall 103 of the column. The thumbscrew threads into a rectangular nut 105 located in the column. The nut has an eye 107 which engages a loop 109 at the lower end of the spring 96. As can be best seen in FIG. 1 of the drawings, the slidable adjustment member 97 has a pointer 113 which aligns with a scale 115 fastened to a side wall of the column 91 to indicate in units of force the tension being exerted by the spring 96 on the cable 75.

A head 121 is provided at the top of the rectangular tubular column 91. It is formed of a U-shaped member 123, shown most clearly in FIG. 3. The U-shaped member provides a side wall 125 and end walls 127 and 129 surrounding the upper end of the rectangular tubular column 91. A separate side wall 131 is connected to the U-shaped member 123 by hex head fasteners 133. The head 121 is mounted on the top of the tubular column 91 by means of set screws 135 which extend through openings 137 in the end walls 127 and 129 of the U-shaped member 123 and fit into openings 139 formed in the end walls 103 of the tubular column 91, as shown most clearly in FIG. 3 of the drawings. A top 141 encloses the head 121.

Vertical grooves 151 are cut out of the side walls of the tubular column 91 extending from the top downwardly to receive sleeve bearings 153. Journaled in the sleeve bearings are trunnions 155 extending from opposite ends of the cable drum 93. A stub shaft 157 attached to one of the trunnions extends outwardly of its sleeve bearing to receive an arm clamp 161. The arm clamp engages and supports the inner end of an L-shaped arm 163. Rotatably mounted on a stub 165 at the distal end of the arm 163 is a pulley 167. A screw 159 extends into trunnion 155 to secure the cable drum 93.

The tension on the spring 96 is initially set by movement of the indicator pointer 113 along the scale 115. When the tension on the uncoiling wire 61 exceeds the preset tension provided by the spring 96, the pulley 167 and arm 163 are pulled downwardly, as viewed in FIGS. 1 and 2 of the drawings. Downward movement of the arm 163 rotates the cable drum 93 in a counterclockwise direction, as viewed in FIG. 2 of the drawings, releasing the tension on the cable 75, which has been pulling down and compressing the spring 65. Releasing the tension on the compression spring 65 allows the spring to lift the rod 33, thus disengaging the braking surface 55 of the cylindrical nut 53 from the filament disk 49. This releases the tension exerted against the uncoiling wire 61 by the filaments 51. Thus, the tension on the uncoiling wire can be preset and closely controlled during uncoiling of the ultrafine wire 61.

A second embodiment of an apparatus involving the novel features of this invention is shown in FIGS. 6–12 of the drawings. The second embodiment of the apparatus includes a hollow base housing 211 which has a bottom metal plate 213 and a plastic cover 215 having a top wall 217 and side and end walls. The plastic cover also includes peripheral flanges 219 extending from the side and end walls, which engage the bottom metal plate 213 and are held thereto by fasteners. The bottom metal plate 213 and plastic cover 215 of the base housing define a cavity 221. Located in the cavity 221 is a rectangular steel ring 225 positioned with its central opening in a vertical position. Formed on the inside of the central opening at one end of the rectangular steel ring is an arcuate notch 227 in which is seated an arcuate tail 229 of an upstanding steel tube 231, the arcuate tail 229 of which extends through an opening 233 formed in the top wall 217 of the plastic cover 215. As can be seen most clearly in FIG. 6 of the drawings, part of the lower end of the steel tube 231 is cut away, except for the arcuate tail 229 which fits in the notch 227 of the steel ring 225, and the tail 229 is fastened to the rectangular steel ring by fasteners 230.

A spool 235 of ultrafine wire 237 is mounted on the upstanding steel tube 231. By ultrafine wire, I am referring to wire having a diameter of 44 to 56 AWG. A sleeve 239 telescopes into the top of the upstanding steel tube 231. The sleeve has an integral flange 241 at its upper end which extends outwardly over the upper end of the steel tube. Diametrically-located tabs 243, formed as part of the flange, fit into slots 245 formed in the top end of the upstanding steel tube 231. The interior passage 247 of the sleeve 239 is hexagonal in transverse cross-section and receives a rod 251 having a hexagonal base 253. The rod has a cylindrical portion 255 at the upper end of its base and a threaded portion 257 at the upper end of its cylindrical portion. A threaded blind hole 259 is formed in the lower end of the hexagonal base 253.

As shown in FIG. 7, a thin, flat, plastic friction member 263 having a pair of diametrically-opposed arms 265 has a central opening 267 which fits over the cylindrical portion 255 of the rod 251, with the plastic friction member supported above the flange 241 of the sleeve 239. Circular holes 269 are formed at the end of each arm and a ceramic eyelet 271 is located in each opening 269 to receive the ultrafine wire 237. Other forms of plastic friction members are shown in FIGS. 8, 9 and 10 of the drawings.

A pair of felt washers 273 are positioned above and below the friction member 263. A spinner nut 275 threads onto the threaded portion 257 of the rod 251 above the upper felt washer 273. The spinner nut has a downwardly-facing surface 277 which engages the upper felt washer 273. A threaded jam nut 279 threads onto the upper end of the rod 21 to lock the spinner nut in a selected position of adjustment.

A coiled compression spring 283 is located in the upstanding steel tube 231 beneath the rod 251. The spring rests on a sleeve 285 located in and secured by a set screw 286 which engages a flat on the side of the sleeve and holds it in position in the lower end of the upstanding steel tube 231.

A cable 291 is connected to a screw 293 threaded in the blind hole 259 in the bottom of the rod 251. The cable functions to pull the rod 251 downwardly against the coiled spring 283 to compress the coiled spring. The cable extends through the sleeve 285, through the opening 233 in the top wall 217 of the base housing cover 215 and into the cavity 221 of the hollow base housing 211 where it is guided around pulleys 297 and 298 horizontally mounted in the open center of the rectangular steel ring 225. The pulleys are journaled on rods 300 which extend across the central opening of the steel ring 225. The pulleys are centered by spacers 301 which telescope over the rods. The cable is then directed upwardly through a rectangular opening 301 in the top wall 217 of the cover 215 and into a rectangular, tubular column 305 mounted on the rectangular steel ring 225 of the base. The bottom of the rectangular steel column is notched to provide a downwardly-extending, U-shaped tab 307 which is fastened to the rectangular steel ring 225 and to a rectangular bracket 309 located inside the column 305 and steel ring 225.

The cable 291 connects to a drum 311 located in a cavity 313 of a housing 315 mounted at the top of the rectangular column 305. The housing is made in two parts 317 held together by fasteners. The connection of the cable to the drum 311 is made by passing the cable through a diametric passage 321 formed in the drum. The cable continues from the drum 311 downwardly to a tension spring 325 which is connected to a slidable adjustment member 327, which can be moved vertically along the length of the rectangular tubular column 305. The adjustment member may be held in a selected position along the column by a thumbscrew 329, which extends through a slot 331 formed in an end wall 335 of the rectangular tubular column 305. The thumbscrew threads into a rectangular nut 337 located in the column. The nut has an eye 339 which engages a loop 341 at the lower end of the spring 325.

As can best be seen in FIG. 1 of the drawings, the slidable adjustment member 327 has a pointer 343 which aligns with a scale 115 fastened to a side wall of the column 305 to indicate in units of force the tension being exerted by the spring 325 on the cable 291.

Aligned circular openings 351 are formed in the two parts 317 of the housing 315. The drum 311, which is located in the cavity 313 of the housing 315, has two trunnions. A shorter tubular trunnion 353 is journaled in one of the circular openings 351 and a longer, solid trunnion 355 extends through the other circular opening 351 to the outside of the housing where it fits into an opening 357 in a pivot arm clamp 359. The pivot arm clamp engages and supports the inner end of an L-shaped arm 361. Rotatably mounted on a stub 363, at the distal end of the arm 361, is a pulley 365. A screw 367 fits into the tubular trunnion 353 to secure the cable drum 311 in position.

The tension on the spring 325 is initially set by movement of the indicator pointer 343 along the scale 115. When the tension on the uncoiling wire 237 exceeds the preset tension provided by the spring 325, the pulley 365 and arm 361 are pulled downward, as viewed in FIG. 6 of the drawings. Downward movement of the arm 361 rotates the cable drum 311 counterclockwise, as viewed in FIG. 6 of the drawings, releasing the tension on the cable 291 which has been pulling down and compressing the spring 283. Releasing the tension pulling on the compression spring 283 allows the spring to lift the rod 251, thus disengaging the braking surface 277 of the spinner nut 275 from the fiber washers 273. This disengagement of the fiber washers releases the friction member 263 and allows it to spin more freely, reducing tension on the wire 237 which passes through the eyelet 271. Thus, the tension on the uncoiling wire can be preset and closely controlled during the uncoiling of the wire.

I claim:

1. A method for establishing and maintaining a selected tension on a fine, metallic wire being uncoiled from a spool of such wire by a pulling force, including the steps of:

engaging said wire with a rotating member as said wire uncoils over one axial end of said spool to require the wire to coil at approximately the same rotational speed as said rotating member, selecting and applying a tension to said wire by controlling the rotational speed of said engaging rotating member through the application of a braking force against said rotating member, and varying the rotational speed of said rotating member to vary the tension applied to said wire by continuously varying the braking force applied to said rotating member as the pulling force applied to the wire varies.

2. The method of claim 1 further characterized in that said wire is engaged by said rotating member by passing said wire through an opening in said rotating member.

3. The method of claim 1 further characterized in that said wire is engaged with said rotating member by passing said wire between radially-extending filaments forming said rotating member.

4. An apparatus for applying and maintaining a predetermined tension on a fine, metallic wire being uncoiled from a spool of wire, including:

a base, a spool-receiving, tubular column mounted on said base and extending above said spool of wire, a member mounted for rotation on a rod extending into the top of the tubular column, said member having at least one outwardly-extending arm with an opening in said arm though which said wire passes, a sleeve positioned in the upper end of said tubular column to receive said rod and having a surface projecting above said tubular column to engage and support said member having at least one arm, a nut threaded to the top of said rod and having a braking surface facing said member having at least one arm, a coiled spring positioned in said tubular column and biasing said rod to move the braking surface of said nut away from said member having at least one arm, a cable connected to said rod to pull said rod directly against the upward force exerted by said coiled spring, and means to reduce the pulling force of said cable against said rod as the pulling force exerted against said fine wire to uncoil it increases, said means including:

a pulley for guiding said fine wire during uncoiling, a pivotally-mounted arm cantileverly supporting said pulley located at the distal end of said arm, the opposite end of said arm operatively connected to said cable to reduce the pulling force of said cable against said rod as said arm pivots due to an increasing pulling force on said pulley exerted by said wire.

5. The apparatus of claim 4 including means to adjust the pulling force exerted by said cable against said rod.

6. An apparatus for establishing and maintaining a selected tension on a fine wire being uncoiled from a spool of such wire by a pulling force, said apparatus including:

a disk mounted for rotation at one end of said spool of wire, said disk having at least one outwardly-extending arm with an opening in said arm through which said wire passes, means to provide a braking resistance against rotation of said disk proportional to the pulling force expected to be applied to the uncoiling wire, and means to continuously adjust said braking resistance applied to said disk as the pulling force applied to said uncoiling wire varies.

* * * * *